US005228402A

United States Patent [19]

Sugimoto

[11] Patent Number: 5,228,402

[45] Date of Patent: Jul. 20, 1993

[54] SEWING MACHINE FOR SEWING CONTINUOUS PATTERN CONSISTING OF PLURALITY OF PARTIAL PATTERNS

[75] Inventor: Nami Sugimoto, Nagoya, Japan

[73] Assignee: Brother Kogyo Kabushiki Kaisha, Nagoya, Japan

[21] Appl. No.: 958,678

[22] Filed: Oct. 9, 1992

[30] Foreign Application Priority Data

Nov. 20, 1991 [JP] Japan ..... 3-332444

[51] Int. Cl.[5] ..... D05B 21/00; D05C 5/04

[52] U.S. Cl. ..... 112/121.12; 112/273; 112/277; 112/454; 112/103

[58] Field of Search ..... 112/121.12, 103, 453, 112/454, 273, 317, 278, 121.11; 364/470

[56] References Cited

U.S. PATENT DOCUMENTS 4,413,574 11/1983 Hirota et al. ..... 112/121.12
4,834,007 5/1989 Miyazaki et al. ..... 112/454 X
5,029,539 7/1991 Yokoe et al. ..... 112/273 X
5,078,068 1/1992 Hager et al. ..... 112/317 X

FOREIGN PATENT DOCUMENTS 57-25882 2/1982 Japan .
57-25885 2/1982 Japan .

*Primary Examiner*—Peter Nerbun
*Attorney, Agent, or Firm*—Oliff & Berridge

[57] ABSTRACT

Stitch data of a plurality of partial patterns constituting a continuous pattern are stored in a predetermined order in a memory. The continuous pattern is sewn by changing the needle thread for each partial pattern. When it is desired to start sewing from a desired position, a head search key is operated to change a pointer P and store a head address of a partial pattern designated by the pointer P into another pointer I and a help key is depressed to cause a help screen to be displayed. An advancing key can then be operated and a stitch number key or keys operated to input a desired number of stitches to advance or retreat. Consequently, the address of the pointer I is displaced by the thus set number of stitch distances in the advancing direction or the retreating direction. When the help screen is the cancelled and a start switch is operated, sewing is started from the needle position indicated by the address of the pointer I.

19 Claims, 12 Drawing Sheets

Fig. 8B

| ITEM | INSTRUCTIONS |
|---|---|
| S1 | EMBROIDERY PATTERN SELECTING PROCESSING |
| S2 | DISPLAY PARTIAL EMBROIDERY PATTERN DISPLAY SCREEN |
| S3 | STORE HEAD ADDRESSES OF ALL PARTIAL EMBROIDERY PATTERNS INTO MEMORY 25a |
| S4 | POINTER P SETTING PROCESSING |
| S5 | POINTER I SETTING PROCESSING |
| S6 | STARTING INSTRUCTION INPUTTED ? |
| S7 | START SEWING MACHINE MOTOR |
| S8 | READ IN EMBROIDERY DATA DESIGNATED BY POINTER I |
| S9 | EMBROIDERY SEWING PROCESSING |
| S10 | STOPPING INSTRUCTION INPUTTED ? |
| S11 | $I \leftarrow I + 1$ |
| S12 | STOP CODE ? |
| S13 | STOP SEWING MACHINE MOTOR |
| S14 | $P \leftarrow P + 1$ |
| S15 | HEAD ADDRESS DESIGNATED BY POINTER P PRESENT ? |
| S16 | I ← HEAD ADDRESS DESIGNATED BY POINTER P |
| S17 | STOP SEWING MACHINE MOTOR |

SEWING MACHINE FOR SEWING CONTINUOUS PATTERN CONSISTING OF PLURALITY OF PARTIAL PATTERNS

BACKGROUND OF THE INVENTION

Field of the Invention

This invention relates to a pattern sewing machine and, more particularly, to a sewing machine which can start sewing from a position displaced by the desired number of stitches from the head or a current intermediate position of a continuous pattern consisting of a plurality of partial patterns.

Description of Related Art

An embroidery sewing machine as a pattern sewing machine has been manufactured in recent years such that it includes an embroidery frame for holding a workpiece thereon, a driving apparatus for driving the embroidery frame to move in the X and Y directions independently of each other, a controlling apparatus for controlling the driving mechanism in accordance with embroidery stitch data, and a ROM card in which embroidery data of a large number of embroidery patterns are stored. The embroidery stitch data of a selected embroidery pattern is read from the ROM card and the driving mechanism is controlled in accordance with the embroidery stitch data thus read to sew the selected embroidery pattern. Each of the embroidery patterns is normally composed of a plurality of partial embroidery patterns, each of the partial embroidery patterns being of one color using the same thread but each partial embroidery pattern may differ in color from the other partial embroidery patterns. Therefore, in the embroidery stitch data for each embroidery pattern, a sewing order of the plurality of partial embroidery patterns is set in advance.

For example, an embroidery pattern for an elephant caricature, as shown in FIG. 11, is composed of 5 partial embroidery patterns consisting of a face part 100, a pair of ears 101, a cap 102, a top portion 103 of the cap, and a pair of eyes, eyebrows and a profile line 104. Thus, includes data of the parts 100 to 104. The sewing order of the embroidery pattern in embroidery sewing is such that the partial embroidery patterns 100, 101, 102, 103 and 104 are successively sewn in order, from the left to the right as shown in FIG. 11. In the case of an embroidery pattern of a large size, up to 30 to 60 minutes are required for sewing the pattern.

If the needle thread is broken during sewing, a thread break detector operates so that the sewing machine is stopped automatically. However, sewing continues for 10 stitches or so before the sewing machine is stopped.

A stitch pattern sewing machine is disclosed in U.S. Pat. No. 4,413,574 wherein, when the needle thread is broken and sewing is to be resumed after re-threading of the needle thread, sewing is resumed from the embroidery stitch data at a stitch that is a predetermined number of stitches (for example, about 100 stitches) prior to the stitch at which the sewing machine was stopped. Further, the sewing machine includes an advancing key and a retreating key for causing the position at which embroidery sewing is to resumed to advanced or retreated by one stitch at a time within the range of the predetermined number of stitches, respectively. Alternatively, when embroidery sewing is stopped due to a breakage of the thread, the sewing machine returns the embroidery needle location to an embroidery starting position or another position displaced by the desired number of stitches prior to the position at which embroidery sewing is stopped due to the breaking of the thread, whereafter embroidery sewing is started from the returned position in response to operation of a sewing starting key.

An electronically controlled stitch pattern sewing machine is disclosed in Japanese Patent Application Laid-Open No. Sho 57-25882 wherein, in order to eliminate a pattern selecting operation upon interruption of sewing, sewing is resumed from the head of the pattern, that was interrupted, in response to a one-point signal designating a pattern unit, a rest signal representative of a rest condition of the sewing machine and a starting instruction signal.

A further stitch pattern sewing machine is also known wherein, when the operator comes aware of an error in the color of the thread or the consumption of the bobbin thread, he/she operates a start/stop switch to stop the sewing machine. To resume sewing, either sewing is resumed from the embroidery data at the stitch the predetermined number of stitches prior to the stitch at which the sewing was stopped or sewing is resumed, in response to operation of a head search key, from the head of the embroidery pattern.

With the conventional embroidery sewing machine, when sewing is to be resumed after interruption of sewing due to a break of the needle thread or the like, it does not substantially matter if sewing is resumed from the embroidery data at a stitch that is the predetermined number of stitches prior to the stitch where sewing was stopped. However, in the case where consumption of the bobbin thread has been overlooked for a few minutes, incomplete sewing may proceed by 100 stitches or more. In this case, the head search key must be operated to resume embroidery sewing from the head of the embroidery pattern. Consequently, the embroidery pattern portion sewn prior to the interruption is quite wasteful. Additionally, when the power supply is inadvertently interrupted during embroidery sewing or when the power supply is interrupted to stop embroidery sewing in order to perform a quite different operation, embroidery sewing cannot be resumed from an intermediate position of the embroidery pattern but must be resumed from the head of the embroidery pattern in a manner similar to that described above.

Thus, none of the conventional embroidery sewing machines are constructed such that embroidery sewing can be started or resumed from a position displaced by the desired number of stitches in the advancing direction from the head of the embroidery pattern or the current position during sewing and incomplete embroidery sewing cannot be completed economically without waste.

SUMMARY OF THE INVENTION

It is an object of the invention to provide a sewing machine which can start sewing from a position advanced by a desired number of stitches from the head or a current intermediate position of a continuous embroidery pattern composed of a plurality of partial patterns.

According to the invention, there is provided a sewing machine which comprises stitch forming means including a sewing needle movable in the vertical direction and a needle thread catcher that cooperates with the sewing needle, driving means for driving the stitch forming means, stitch data storage means in which stitch data of a continuous pattern composed of a plurality of partial patterns are stored separately for the partial patterns, controlling means for controlling driving of the driving means in accordance with the stitch data of the stitch data storage means, designating means for designating stitch data of an arbitrary partial pattern from within the stitch data stored in the stitch data storage means, moving means for designating stitch data displaced by an arbitrary number of stitch data distances from the stitch data of the partial pattern designated by the designating means, and supplying means for reading out the stitch data designated by the moving means from the stitch data storage means and supplying the stitch data to the controlling means.

In the sewing machine, the driving means for driving the stitch forming means is controlled to be driven in accordance with stitch data by the controlling means so that a pattern is sewn on a workpiece. The stitch data storage means stores therein stitch data of a continuous pattern, which is composed of a plurality of partial patterns, separately for each of the partial patterns. The moving means designates stitch data displaced by an arbitrary number of stitch data distances from stitch data of the partial pattern designated by the designating means.

Accordingly, when sewing of a pattern is interrupted due to some trouble or due to interruption of the power supply, the read position of the stitch data can be displaced to a desired position from which it is desired to resume sewing so that sewing may be started from an arbitrary partial pattern. Consequently, sewing can be resumed continuous to the already sewn portion.

Therefore, when sewing is to be resumed after interruption of the sewing of a pattern, sewing can be resumed without making the already sewn portion wasteful and, consequently, an otherwise possible loss involved in the interruption can be eliminated completely and the operating efficiency in the sewing of a pattern can be raised remarkably.

BRIEF DESCRIPTION OF THE DRAWINGS

FIG. 8B is a table of labels of the flowchart of FIG. 8A;

DETAILED DESCRIPTION OF THE PREFERRED EMBODIMENTS

A preferred embodiment of the invention will be described below with reference to the drawings.

In the embodiment, the invention is applied to an electronically controlled embroidery sewing machine on which an embroidery apparatus can be removably mounted and by which various embroidery pattern stitches can be sewn.

Figure 1:
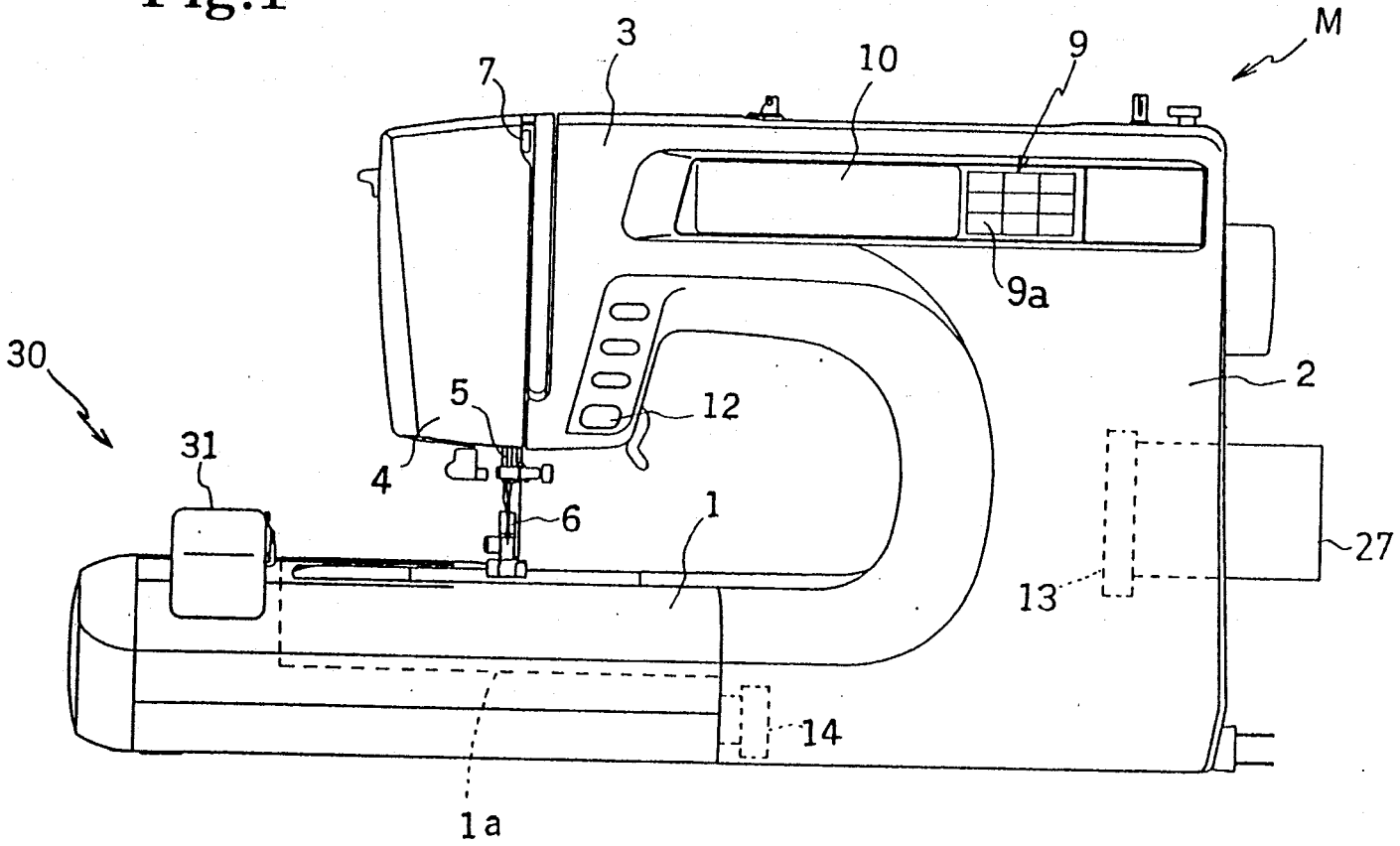
FIG. 1 is a front elevational view of an electronically controlled embroidery sewing machine.

Referring to FIG. 1, an electronically controlled embroidery sewing machine M includes a sewing machine bed 1, a column 2 extending uprightly from a right end portion of the bed 1 and an arm 3 extending leftwardly from the top end of the column 2 in an opposing relationship to the bed 1 (as viewed in the figure). The bed 1 includes a feed dog vertically moving mechanism (not shown) for moving a feed dog upwardly and downwardly, a feed dog forwardly and backwardly moving mechanism (not shown) for moving the feed dog forwardly and backwardly, and a needle thread catcher (for example, a horizontal cylinder) which accommodates a thread bobbin therein and cooperates with a sewing needle 6, and so forth. The arm 3 includes a needle bar driving mechanism for moving a needle bar 5, which can mount the sewing needle 6 at the lower end thereof, upwardly and downwardly, a needle bar rocking mechanism for rocking the needle bar 5 in a direction perpendicular to the workpiece feeding direction, and a thread take-up lever driving mechanism (not shown) for moving a thread take-up lever 7 upwardly and downwardly in a timed relationship with upward and downward movement of the needle bar 5. It is to be noted that the feed dog vertically moving mechanism, the needle bar driving mechanism and the thread take-up lever driving mechanism are driven by the sewing machine motor 17, and the feed dog forwardly and backwardly moving mechanism is driven by a feed dog driving stepping motor 19 while the needle bar rocking mechanism is driven by a needle bar rocking stepping motor 18.

A large size liquid crystal display 10 is provided on the front face of the arm 3. Various stitch patterns, such as utility patterns and embroidery patterns, figures and various messages, are displayed on the display 10. A total of 30 touch keys 11, formed from transparent electrodes, are provided overlaying the front face of the display 10, so as to divide the display into 30 selection zones or points, in a corresponding relationship that provides at least one touch key to each of the plurality of displayed stitch patterns and other display items so that a desired stitch pattern can be selected by depressing an appropriate one of the touch keys 11 corresponding to and overlaying the pattern.

A start/stop switch 12 for starting and stopping the sewing operation is provided on the head 4. A card slot for mounting a ROM card (pattern card) 27 onto a card connector 13 in the inside of the column 2 is formed in the column 2. The ROM card 27 has stored therein embroidery stitch data of a plurality of embroidery patterns for embroidery sewing of various figurative patterns, characters, marks and one point marks. Further, an operation panel 9 is provided on the front face of an upper end portion of the column 2. A total of nine function keys are provided on the operation panel 9. The function keys include a utility sewing key for causing a utility pattern to be displayed, a character sewing key for causing a character pattern to be displayed, and a card key 9*a* for causing an embroidery pattern to be displayed.

A free arm 1*a* is formed at a left end portion of the bed and an embroidery apparatus 30 is removably mounted on the free arm 1*a*. An embroidery table 31 is provided on the embroidery apparatus 30 for movement in the Y direction parallel to the workpiece feeding direction (forward and backward direction) and the X direction (leftward and rightward direction) perpendicular to the Y direction. An embroidery frame (not shown) for mounting a workpiece thereon is removably mounted on the embroidery table 31. A first stepping motor 32 (refer to FIG. 2) for feeding the embroidery table 31 in the X direction and a second stepping motor 33 (refer to FIG. 2) for feeding the embroidery table 31 in the Y direction are disposed in a body frame of the embroidery apparatus 30. Accordingly, various embroidery patterns can be formed on a workpiece mounted on the embroidery frame by the coordinated driving movement of the stepping motors 32 and 33 and the upward and downward movement of the needle bar 5 in response to driving signals supplied to them from the sewing machine M by way of a connector 14.

Figure 2:
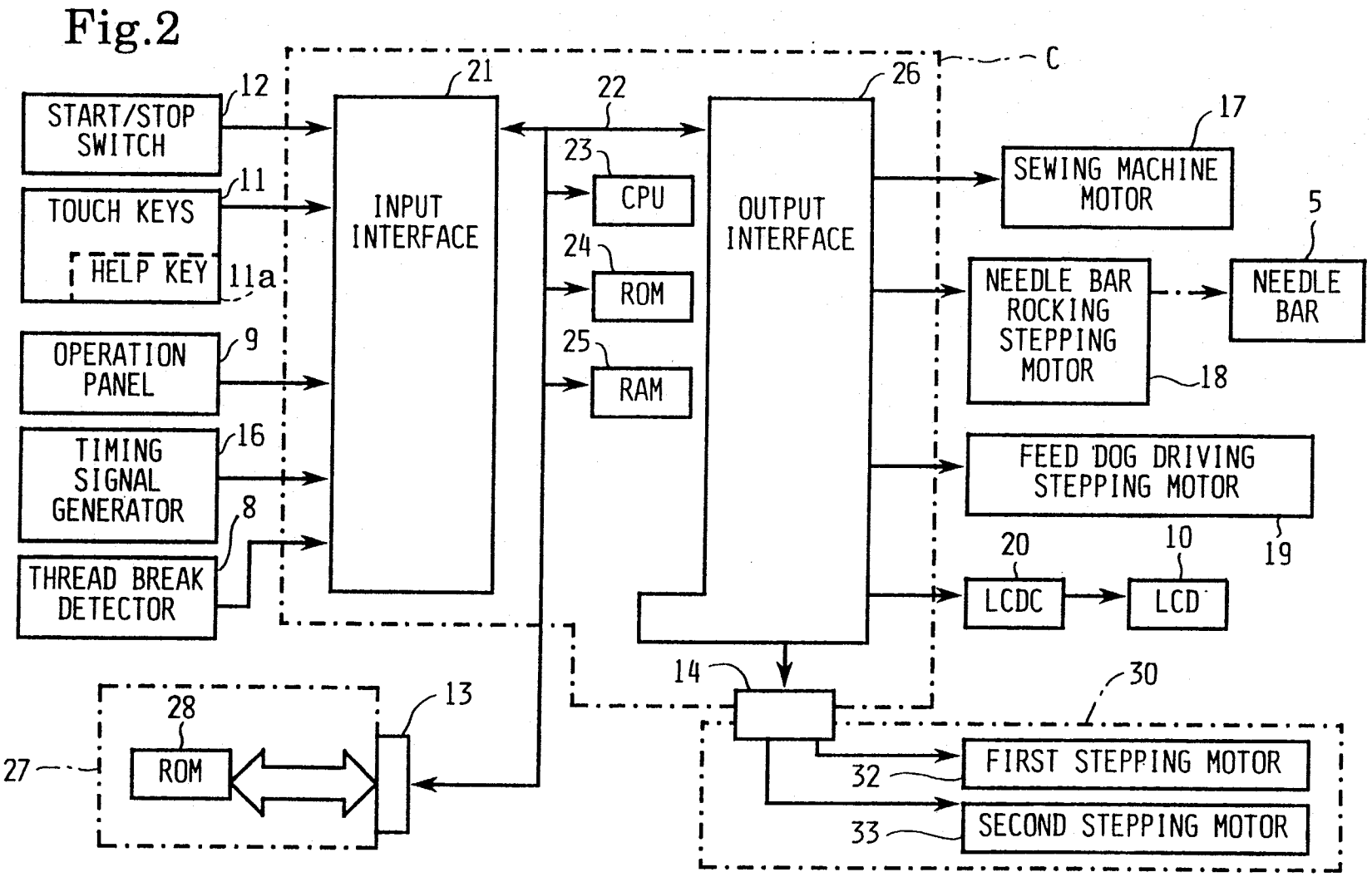
FIG. 2 is a block diagram of a controlling system for the embroidery sewing machine.

An outline of a controlling system of the sewing machine M will be described with reference to FIG. 2.

The start/stop switch 12, the touch keys 11, the operation panel 9 and a timing signal generator 16 are connected to an input interface 21 of a controlling apparatus C. A thread break detector 8 detects a break of the needle thread or the consumption of the bobbin thread. A help key 11*a* of the touch keys 11 causes, when it is operated upon occurrence of a break of a needle thread or the consumption of the bobbin thread during embroidery sewing, a screen shown in FIG. 5 to be displayed.

The sewing machine motor 17, the needle bar rocking stepping motor 18, the feed dog driving stepping motor 19 and a display controller (LCDC) 20 for the display (LCD) 10 are connected to an output interface 26 of the controlling apparatus C. Further, the first and second stepping motors 32 and 33 of the embroidery apparatus 30 are connected to the output interface 26 by way of the connector 14.

Figure 6:
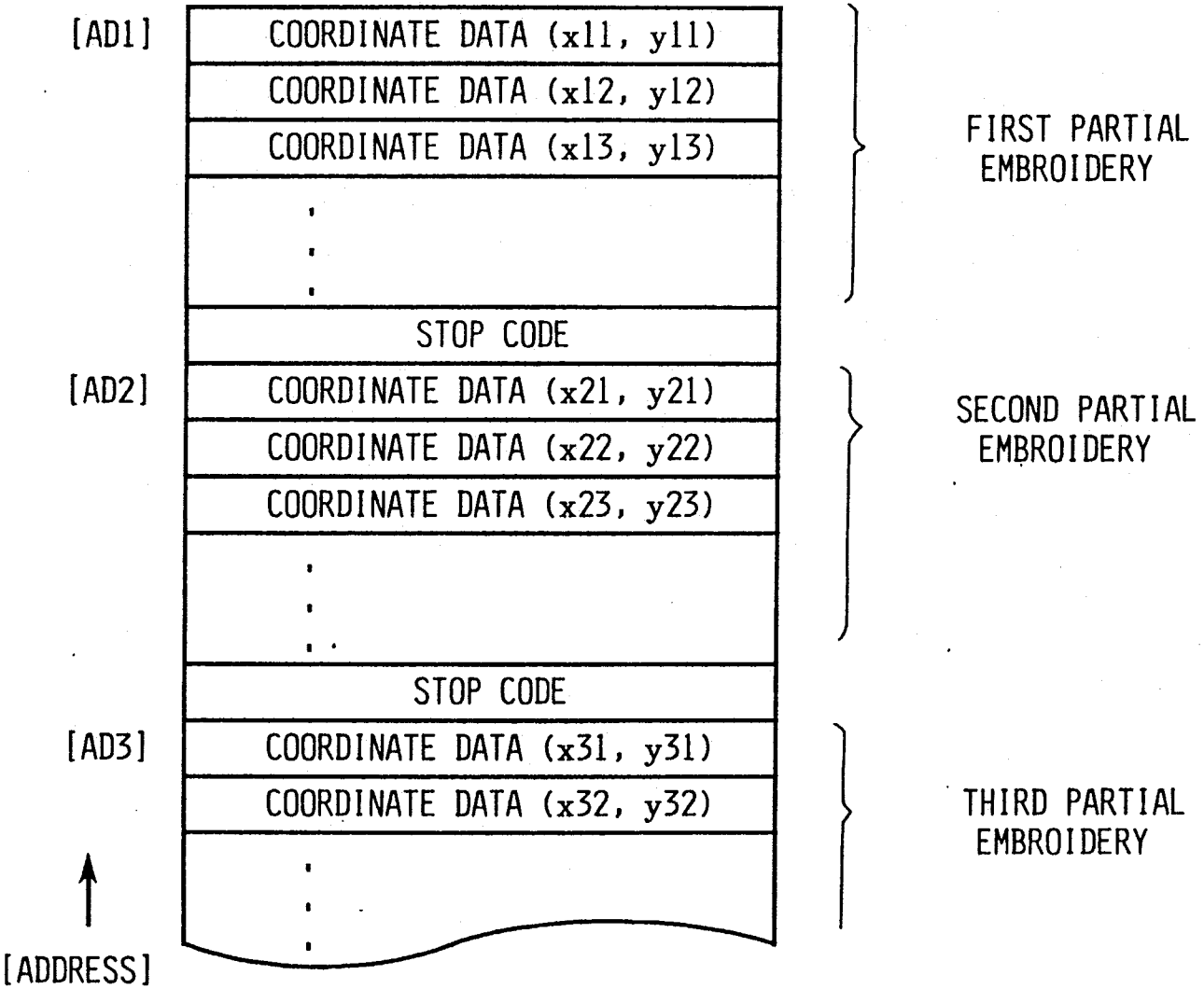
FIG. 6 is a diagrammatic view illustrating configuration of embroidery stitch data in a ROM card.

The controlling apparatus C includes a CPU 23, the input interface 21, the output interface 26, a ROM 24 and a RAM 25 all connected to the CPU 23 by way of a bus 22 such as data bus. A ROM 28 of the ROM card 27 described above is connected to the bus 22 by way of the connector Embroidery stitch data of the plurality of embroidery patterns described above are stored in the ROM 28 of the ROM card 27 in a corresponding relationship to pattern code numbers for the different kinds of patterns. Each of the embroidery patterns is composed of a plurality of partial embroidery patterns. Embroidery stitch data for each of the embroidery patterns are stored in ROM 28, as illustrated in FIG. 6, wherein they are arranged in the predetermined order of a first partial embroidery pattern, a second partial embroidery pattern, a third partial embroidery pattern and so on. The embroidery stitch data of each partial embroidery pattern is composed of a plurality of coordinate data representative of positions to which the embroidery frame is to be successively moved and a stop code designating the end of the partial embroidery pattern.

The ROM 24 stores in advance therein a driving controlling program for driving the motors 17 to 19, a display controlling program for causing the display 10 to display various display items, a control program for embroidery sewing control for controlling the first and second stepping motors 32 and 33 in accordance with embroidery stitch data, and another control program for reading out position designating control, which will be hereinafter described, incidental to the control program for embroidery sewing control and peculiar to the invention. However, since the controls, except the reading out position designating control which is peculiar to the invention, are conventional controls, description of them is omitted. The RAM 25 has pointers, counters, and buffers and so forth for temporarily storing results of calculations by the CPU 23.

The reading out position designating control which is executed by the controlling apparatus C of the sewing machine M will be described.

Figure 3:
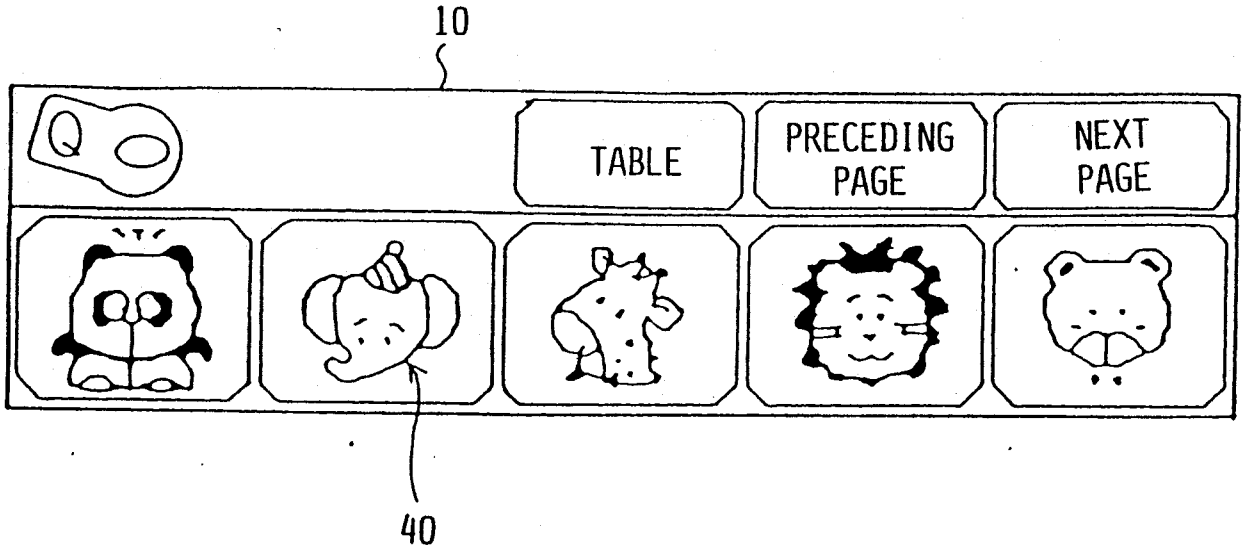
FIG. 3 is a schematic view showing an exemplary display when an embroidery pattern is to be selected.
Figure 4:
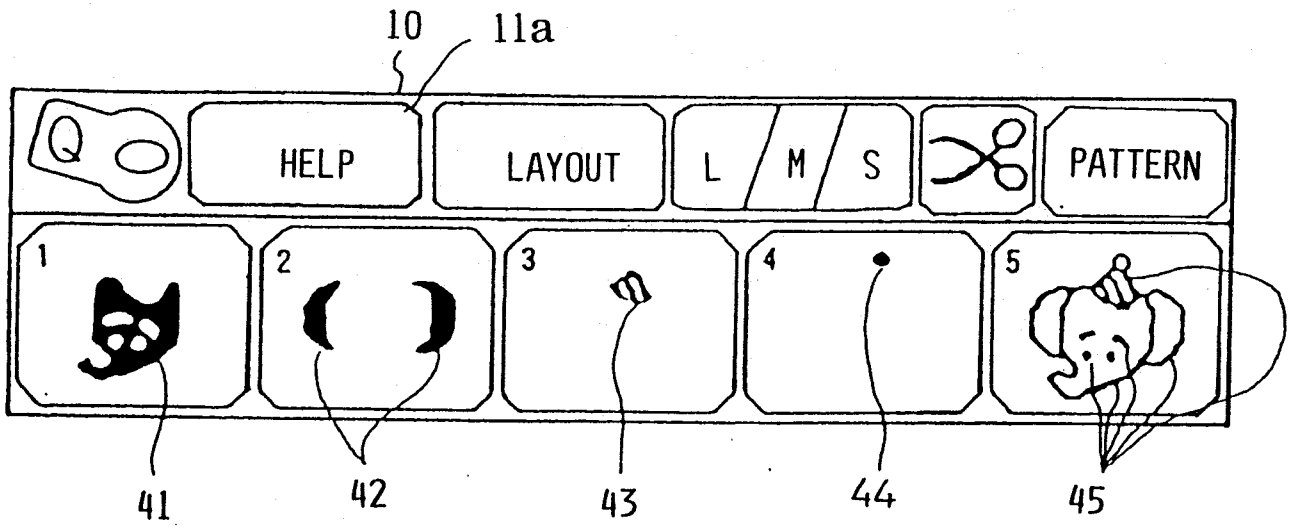
FIG. 4 is a similar view but showing an exemplary display of a partial pattern display screen.

First, power will be supplied to the sewing machine M. Then the card key 9*a* of the operation panel 9 will be operated when the ROM card 27, in which embroidery stitch data of a large number of embroidery patterns are stored, is set in position. Consequently, the first five embroidery patterns in the ROM card 27 are displayed on the display 10 as shown in FIG. 3. The displayed contents of the display 10 may be changed by manual operation of an appropriate one of the touch keys 11 overlaying the indication of "PRECEDING PAGE" or "NEXT PAGE". When a desired embroidery pattern is displayed, at least one of the appropriate touch keys 11 overlaying the indication of the desired embroidery pattern will be manually operated to select the embroidery pattern. Thus, if it is assumed that, for example, an embroidery pattern 40 representing an elephant is selected from the display of FIG. 3, five partial embroidery patterns constituting the embroidery pattern 40, that is, a face 41, ears 42, a cap 43, a top portion 44 of the cap, and eyes, eyebrows and profile lines 45, are displayed on the display 10 as shown in FIG. 4.

There may be more than the five partial embroidery patterns of this example. In such a case, a display similar to FIG. 3 is provided allowing the operator to go to the next page of partial embroidery patterns or return to the preceding page if at a partial embroidery pattern greater than five. The number of partial embroidery patterns may also be less than five.

Subsequently, the start/stop switch 12 will operated, after a needle thread of the color required for the first partial embroidery pattern (face 41) is threaded, to start embroidery sewing of the first partial embroidery pattern by the embroidery sewing machine M. When the embroidery sewing of the first partial embroidery pattern is completed, the embroidery sewing machine M is stopped in response to the stop code (FIG. 6), and the needle thread changed, if appropriate, to that required for the next partial embroidery pattern. After that, embroidery sewing will be performed successively for the second partial embroidery pattern and the sequence followed for the remaining partial embroidery patterns.

Figure 5:
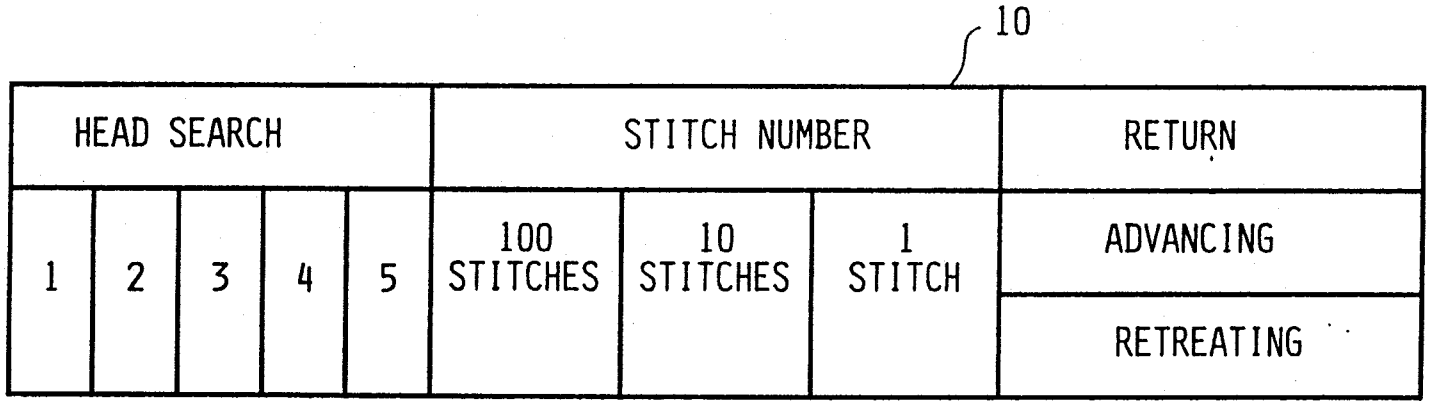
FIG. 5 is a schematic view showing an exemplary display of a help screen.

Here, when a trouble occurs, such as a break of the needle thread or consumption of the bobbin thread, during the process of embroidery sewing and the embroidery sewing is interrupted, the help key 11*a* is operated. As a result, the menu item of "HEAD SEARCH" and the sub-menu items of partial embroidery pattern numbers "1" to "5", the menu item of "STITCH NUMBER" and the sub-menu items of "100 STITCHES", "10 STITCHES" and "1 STITCH", and the menu items of "RETURN", "ADVANCE" and "RETREAT" are displayed on the display 10 as shown in FIG. 5.

The appropriate ones of touch keys 11 overlaying the sub-menu items of "1" to "5" are head search keys for designating the heads of the first to fifth partial embroidery patterns, respectively. The appropriate ones of the touch keys 11 overlaying the sub-menu items of "100 STITCHES", "10 STITCHES" and "1 STITCH" are stitch number inputting keys for causing the reading of embroidery stitch data to advance or retreat by 100 stitches, 10 stitches and 1 stitch, respectively. The appropriate ones of the touch keys 11 for the menu item of "RETURN" return the display screen from the help screen, shown in FIG. 5, to the partial embroidery pattern display screen of FIG. 4; the appropriate ones of the touch keys 11 overlaying the menu item of "ADVANCE" cause the read of embroidery stitch data to advance; and the appropriate ones of the touch keys 11 overlaying the menu item of "RETREAT" cause the read of embroidery stitch data to retreat.

Accordingly, on the help screen, the read position of embroidery stitch data can be moved to the head of a desired partial embroidery pattern by way of the head search key or it can be caused to advance or retreat, by a desired number of stitches by way of a combination of operations of the represented stitch number inputting keys using appropriate ones of the touch keys 11. Therefore, when embroidery sewing is started after an interruption or is newly started, the reading of data and embroidery sewing from a desired position of a desired partial embroidery pattern of an embroidery pattern can be performed.

Figure 7:
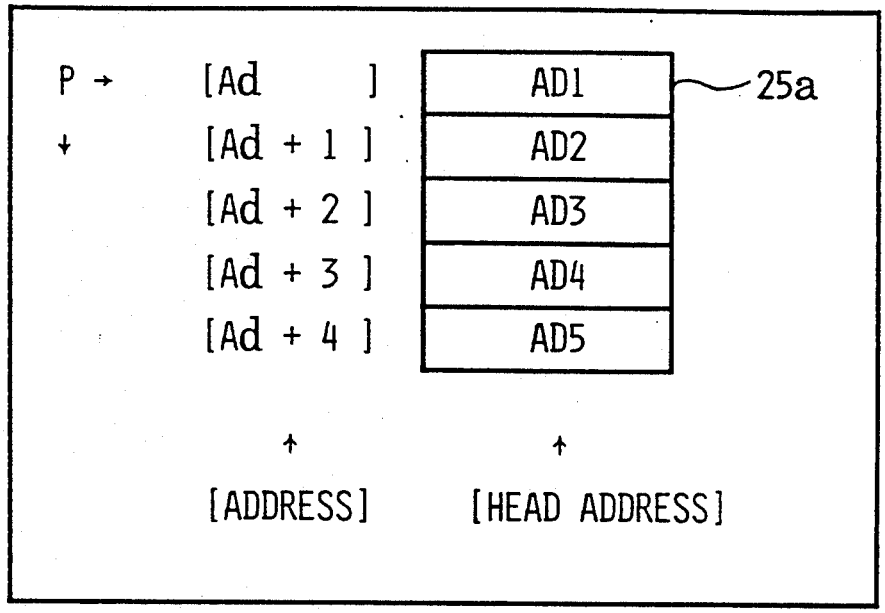
FIG. 7 is a diagrammatic view illustrating a head address memory of a RAM.
Figure 8A:
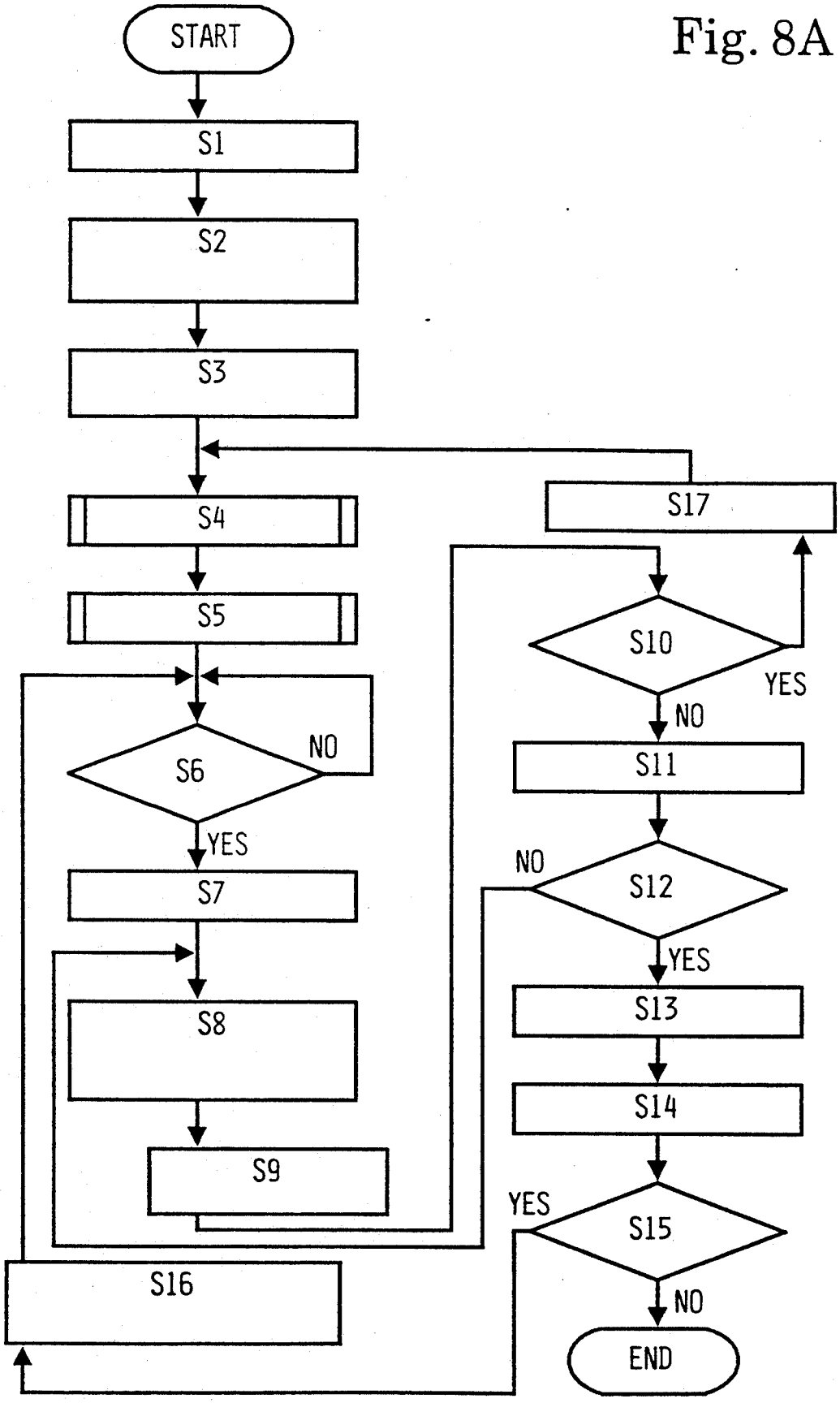
FIG. 8A is a flow chart illustrating a routine for reading out position designating control.

The routine for reading out position designating control will be described with reference to the flow charts of FIGS. 8A to 10. It is to be noted that reference characters Si (i=10, 11, 12, . . . ) in FIGS. 8A, 8B, 9 and 10 denotes a step. The head address memory 25*a*, a pointer P specifying an address of the memory 25*a* and another pointer I specifying an address of embroidery stitch data of the ROM card 27, as shown in FIG. 7, are provided in the RAM 25.

A controlling operation is started in response to operation of the card key 9*a* of the operation panel 9. The process of selecting an embroidery pattern is first executed in accordance with selection of the embroidery pattern (S1). After that, the display screen of the display 10 is changed to the partial embroidery pattern display screen so that all of partial embroidery patterns of the selected embroidery pattern are displayed on the display 10 (S2). Subsequently, head addresses of all of the partial embroidery patterns are read in from embroidery stitch data of the selected embroidery pattern in the embroidery stitch data of the ROM card 27 and are stored into the head address memory 25*a* (S3), as shown in FIG. 7.

The pointer P setting processing for setting the pointer P is then executed in accordance with the routine shown in FIG. 9 (S4), and subsequently, pointer I setting processing for setting the pointer I is executed in accordance with the routine shown in FIG. 10 (S5). It is to be noted that, when embroidery sewing is newly started, the address Ad is placed into the pointer P and a head address AD1 designated by the pointer P is placed into the pointer I.

Subsequently, when the start/stop switch 12 is operated (S6, Yes), the sewing machine motor 17 is energized (S7) and the embroidery stitch data designated by the pointer I are read in from the ROM card 27 (S8). Then, the first and second stepping motors 32 and 33 are controlled to be driven in accordance with the embroidery stitch data thus read in to perform embroidery sewing processing (S9). If no stopping instruction is input (S10, No), the pointer I is incremented by one (S11). If the embroidery stitch data designated by the pointer I are not a stop code (S12, No), the control returns to step S8 to repeat the operations at steps S8 to S12 and embroidery sewing proceeds successively in this manner. Then, when the embroidery sewing of the first partial embroidery pattern is completed and a stop code is read (S12, Yes), the sewing machine motor 17 is stopped (S13) and the pointer P is incremented by one (S14).

At step S15, it is judged whether or not there remains a head address (AD1 to AD5 in the example) designated by the pointer P. Before embroidery sewing of all of the partial embroidery patterns is completed, the judgment at step S15 is Yes and, consequently, the control advances from step S15 to step S16, at which the head address designated by the pointer I is set to the head address designated by the pointer P. The control sequence then advances to step S8 to repeat the operations beginning with step S8. However, since the pointer P has been incremented and now indicates the address Ad+1 of the memory 25*a*, embroidery sewing of the second partial embroidery pattern is performed in the same manner as described above.

The sequence of operations is repeated in this manner until embroidery sewing of all of the partial embroidery patterns is completed and, consequently, the judgment at step S15 finally changes to No, thereby completing the control. It is to be noted that while such a display as shown in FIG. 4 appears on the display 10 during embroidery sewing, the first to fifth partial embroidery patterns are successively scrolled so that the one of the partial embroidery patterns which is currently being sewn may be positioned at the leftmost indicating position among the partial embroidery patterns.

When trouble, such as a break of the needle thread or consumption of the bobbin thread, takes place, a stopping instruction from the thread break detector 8 is input. When either a stopping instruction from thread break detector 8 or a stopping instruction from the start/stop switch 12 is input, the judgment at step S10 changes to Yes and the control advances from step S10 to step S17, at which the sewing machine motor 17 is stopped, whereafter the control advances from step S17 to step S4.

The pointer P setting processing will now be described with reference to FIG. 9.

After the processing is started, when the help key 11*a* is not operated (S30, No), such as when embroidery sewing is newly started, the address Ad is placed into the pointer P (S31) and control for initially setting the position of the embroidery frame is executed (S32). In this instance, since a flag F is not yet in a set state (S39, No), the control returns to the routine of FIG. 8.

If the help key 11*a* is operated (S30, Yes) when the operator wants to perform searching for the head of one of the second to fifth partial embroidery patterns, for example, or when embroidery sewing which has been previously interrupted is to be resumed from an intermediate portion of the embroidery pattern, the flag F is set (S33) and the help screen shown in FIG. 5 is displayed on the display 10 (S34). It is to be noted that control for the display is included in advance in the display controlling program.

If the operator then operates one of the head search keys for "1" to "5" (S35, Yes), the pointer P is set in response to the operated head search key (S36).

For example, if the head search key for "3" is operated in order to designate the head of the third partial embroidery pattern, the pointer P is set to Ad+2. Subsequently, control for moving the embroidery frame to a position corresponding to the pointer P set, in the manner described above, is executed (S37).

In case the pointer P is changed from Ad (current position) to, for example, Ad+2 in the embroidery frame moving control, a total of X coordinate values and a total of Y coordinate values of coordinate data of the first and second partial embroidery patterns are calculated, and the embroidery frame is controlled to be moved by the total of the X coordinate values and the total of the Y coordinate values. In short, the embroidery frame is controlled to be moved to the last stitch position of the second partial embroidery pattern.

Subsequently, the control advances from step S37 to step S39 and, in this instance, since the flag F is in a set state (S39, Yes), the control advances to step S40 at which it is judged whether or not the return key is operated. If the return key is not operated, the control returns from step S40 to step S35. At that point, a head search key can be again operated. It is to be noted that, in the case where no head search key is operated after operation of the help key 11*a*, the judgment at step S35 is No and the pointer P is maintained (S38). Then, if it is desired to restore the display screen for embroidery sewing after a head searching operation, the return key will be operated (S40, Yes), and consequently, the flag F is reset (S41) and the screen restoring processing is executed (S42). The control then returns to the routine shown in FIG. 8.

The pointer I setting processing will be described with reference to FIG. 10.

After the processing is started, a head address designated by the pointer P is placed into the pointer I (S50) and if no key is operated, for example, when embroidery sewing is started newly, the control returns to the routine of FIG. 8 by way of the steps S51, S54, S56, S58, S61 and S62. In short, when embroidery sewing is newly started, the pointer P is set to the address Ad and the pointer I is set to the address AD1 designated by the address Ad. As a result, embroidery sewing from the head of the first partial embroidery pattern is started.

On the other hand, when embroidery sewing is to be resumed from a desired position of a desired partial embroidery pattern, such as when embroidery sewing which has been interrupted is to be resumed, the help key 11*a* will be operated (S51, Yes) and, consequently, the flag F is set (S52) and the help screen is displayed (S53), whereafter the control returns to step S51. Then, if the advancing key is operated because it is desired to advance the reading out position of the embroidery stitch data in the advancing direction (in the direction in which the address increases) of the embroidery stitch data memory 28 (S54, Yes), a flag FF is set (S55) and the control returns to step S51. Then, if the stitch number inputting keys for "100 STITCHES", "10 STITCHES" and "1 STITCH" are operated successively once each, at the help screen, in order to set a stitch number that the read embroidery is to be moved in the advancing direction, then the judgment at step S58 is Yes, and the control advances to step S59, at which time the pointer I is set to $I+\Delta I$($\Delta I=111$ in this example) and the flag FF is reset. Then at step S60, the embroidery frame is controlled to be moved by an amount corresponding to $\Delta I$, in a manner similar to that described above, whereafter the control returns to step S51.

On the other hand, if the retreating key is operated (S56, Yes) when it is desired to displace the reading out position of the embroidery stitch data in the retreating direction (in the direction in which the address decreases) of the embroidery stitch data memory 28, a flag FB is set (S57), whereafter the control returns to step S51. Then, if a stitch number inputting key, or keys, is operated (S58, Yes), similarly to the description above, in order to set the number of stitches the reading out position of embroidery stitch data is to retreat, the pointer I is set to $I-\Delta I$ in accordance with the input stitch number and the flag FB reset (S59). The control then returns to step S51 by way of step S60 as described above.

If no key is operated after setting for advancement or retreat or there is no setting of the input stitch number, the pointer I is maintained at its current position at step S61, so far as the returning key has not been operated, and the Flag F remains in a set state so that the control returns to step S51 by way of steps S62 and S63. Since the flag FF or FB is reset after setting the pointer I at step S59, the advancing key, the retreating key and the stitch number inputting keys can again operated.

When it is desired to restore the screen in order to perform embroidery sewing after completion of the necessary key operations, the returning key will be operated (S63, Yes) and the flags FF, FB and F are reset (S64). Then the screen restoring processing is executed (S65) and the control returns to the routine of FIG. 8.

Figure 9:
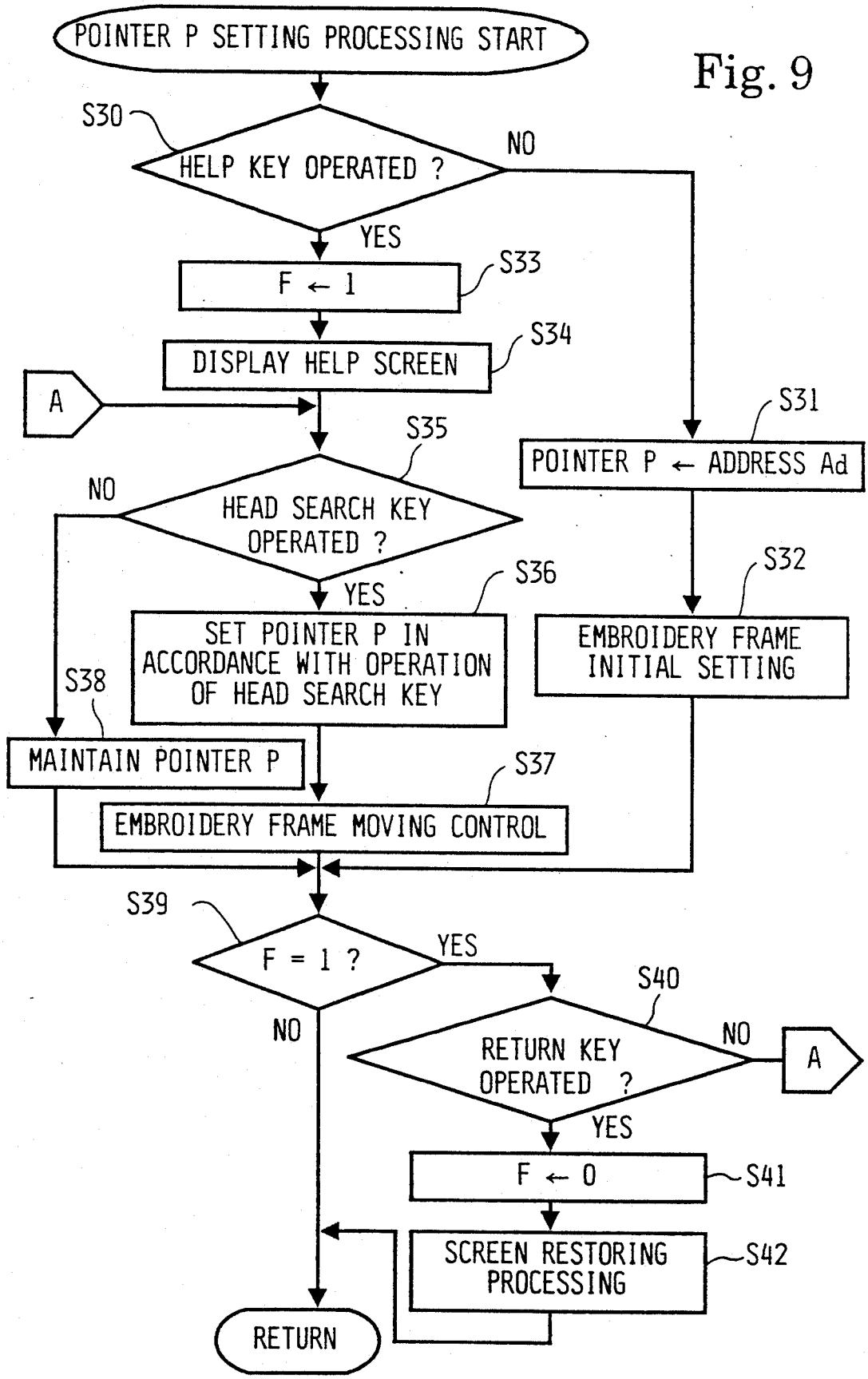
FIG. 9 is a flow chart illustrating pointer P setting processing of the routine of FIG. 8.
Figure 10:
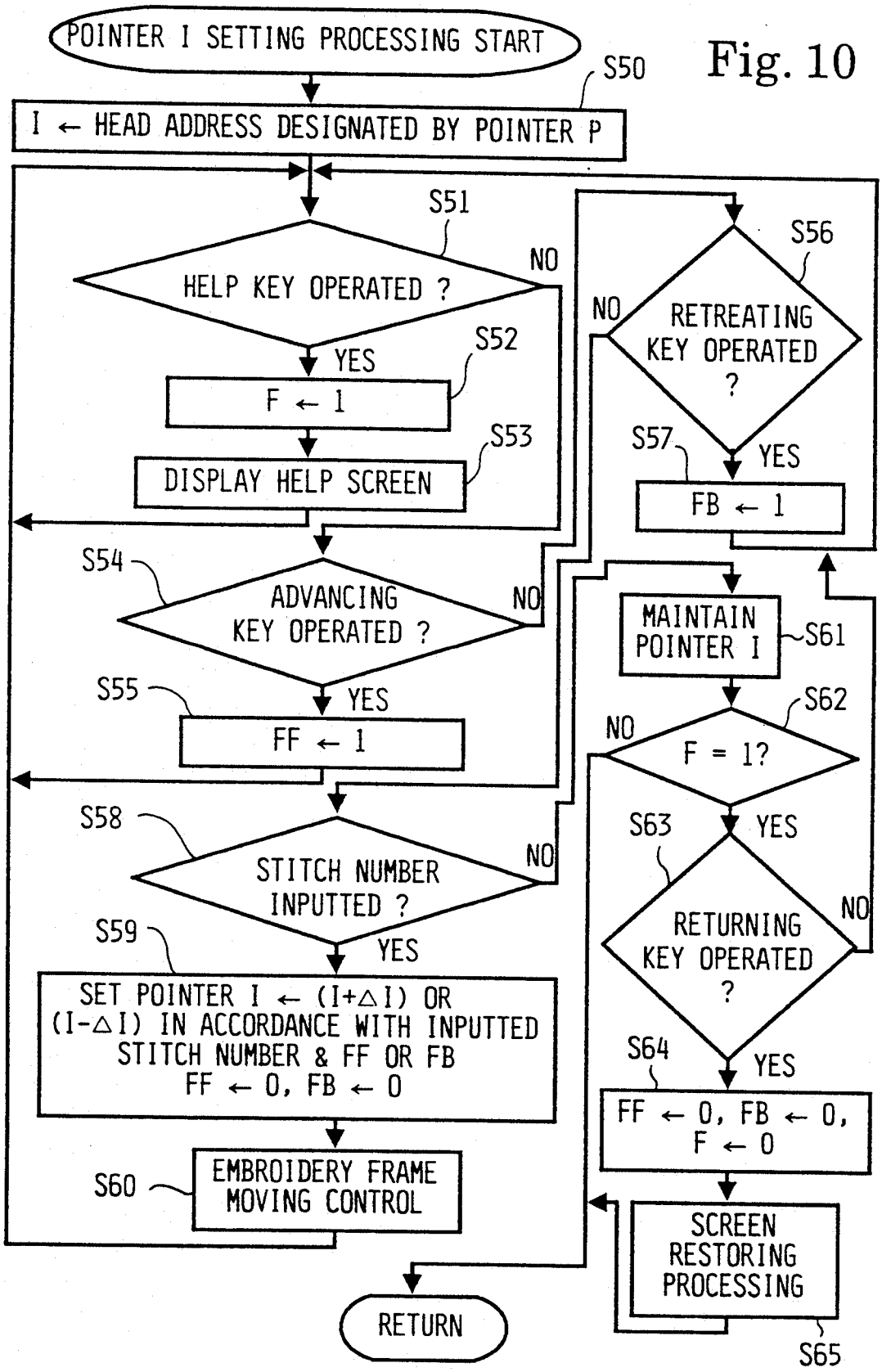
FIG. 10 is a flow chart illustrating pointer I setting processing of the routine of FIG. 8.
Figure 11:
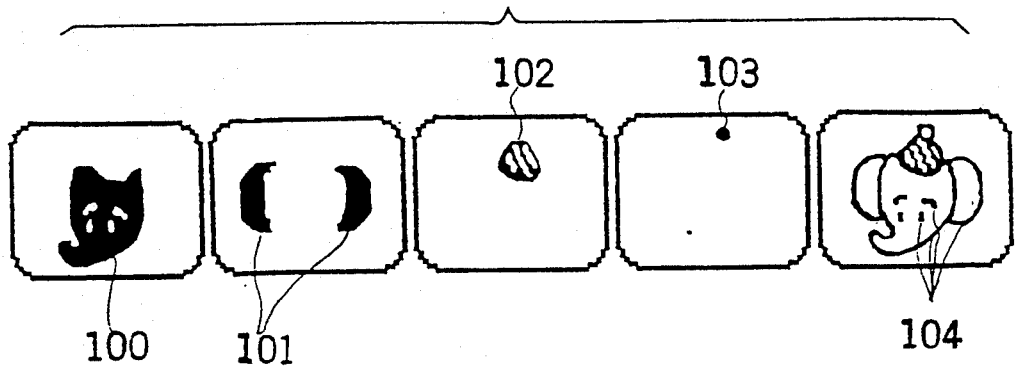
Fig.11 PRIOR ART
FIG. 11 is a schematic view showing partial patterns of an embroidery pattern of the prior art.

As described so far, since the routine for pointer P setting processing of FIG. 9 and the routine for pointer I setting processing of FIG. 10 are provided in addition to the help key, the head search key, the stitch number inputting keys, the advancing key, the retreating key and the returning key, when embroidery sewing is to be newly started or when embroidery sewing is resumed after interruption, the pointer P and the pointer I can be freely set to read embroidery data from a desired position of a desired partial embroidery pattern and then to perform embroidery sewing in accordance with the thus read embroidery stitch data.

Accordingly, when embroidery sewing is to be resumed after interruption of embroidery sewing due to a break of the needle thread or consumption of the bobbin thread, or after interruption of embroidery sewing due to an unintended or intended interruption of the power supply, embroidery sewing can be resumed continuously from the embroidered portion. Consequently, the embroidered portion can be effectively used without waste, and the operating efficiency in embroidery sewing can be raised remarkably.

It is to be noted that naturally all of the embroidery stitch data of a selected embroidery pattern of embroidery stitch data of the ROM card 27 may alternatively be read into the memory of the RAM 25 after selection of the embroidery pattern so that the embroidery stitch data may be used from thereon. Further, the head search key, the stitch number inputting keys and the other keys may be independent keys or may be a combination of independent keys and ten numbered keys.

Further, the advancing key may be configured so that, when it is depressed once, the embroidery frame is moved by one stitch distance in the advancing direction, but when it is kept depressed, the embroidery frame is moved successively until the advancing key is released, i.e., it has a repeat function. The retreating key may also operate in a similar manner. In this instance, the stitch number inputting keys are unnecessary.

It is to be noted that, while the sewing machine of the embodiment is described above wherein embroidery stitch data of embroidery patterns are stored in the ROM card 27, such embroidery stitch data may be stored in the ROM 24 of the controlling apparatus C or another ROM in place of the ROM card 27. Further, the display 10 may be a color display on which partial embroidery patterns are displayed in the colors designated for the individual partial embroidery patterns.

Further, while embroidery patterns formed on an embroidery sewing machine provided with the embroidery apparatus 30 are described as an example of pattern stitches, the invention can be applied to a zigzag sewing machine which is not provided with such an embroidery apparatus 30 but forms a pattern stitch by changing the relative positions of the sewing needle 6 and the workpiece. In the invention, a pattern is defined including an embroidery pattern formed by an embroidery sewing machine and another pattern formed by a zigzag sewing machine.

It is to be noted that the reading out position designating control in the embodiment described above is illustrated as a mere example and many changes and modifications can be made to the embodiment described above without departing from the spirit and scope of the invention as set forth herein.

What is claimed is:

1. A sewing machine comprising:

stitch forming means for forming stitches;

driving means for driving said stitch forming means;

stitch data storage means for storing stitch data of a continuous pattern including a plurality of partial patterns;

controlling means for controlling driving of said driving means in accordance with the stitch data of said stitch data storage means;

first designating means for designating stitch data related to a predetermined stitch position of an operator selected partial pattern from among the stitch data stored in said stitch data storage means;

second designating means for designating stitch data displaced by an operator designated number of stitch data from the stitch data related to the predetermined stitch position designated by said first designating means; and supplying means for reading the stitch data designated by said second designating means from said stitch data storage means and supplying the stitch data to said controlling means.

2. The sewing machine as claimed in claim 1, wherein the stitch data of each of the partial patterns stored in said stitch data storage means includes a plurality of coordinate data indicative of relative positions of said sewing needle and a workpiece and end data indicative of an end of the partial pattern, and the stitch data of the continuous patterns are composed of stitch data of a plurality of partial patterns.

3. The sewing machine as claimed in claim 2, wherein said stitch data storage means stores the stitch data in a predetermined order therein and said second designating means designates stitch data displaced in an advancing direction by a distance resulting from the operator designated number of stitch data.

4. The sewing machine as claimed in claim 2, wherein said stitch data storage means stores the stitch data in a predetermined order therein and said second designating means designates stitch data displaced in a retreating direction by a distance resulting from the operator designated number of stitch data.

5. The sewing machine as claimed in claim 1, further comprising display means for displaying the plurality of partial patterns thereon, wherein said first designating means designates a partial pattern from the plurality of partial patterns displayed.

6. A sewing machine, comprising:

stitch forming means for forming stitches;

driving means for driving said stitch forming means;

stitch data storage means for storing stitch data of a continuous pattern including a plurality of partial patterns in a predetermined order;

controlling means for controlling driving of said driving means in accordance with the stitch data of said stitch data storage means;

display means for displaying the plurality of partial patterns thereon;

stopping means for stopping said driving means;

first designating means for designating, after said driving means is stopped by said stopping means, one of the plurality of partial patterns displayed on said display means;

address storage means for storing an address of the stitch data in the partial pattern designated by said first designating means;

second designating means for designating stitch data displaced by distance resulting from an operator designated number of stitch data from the stitch data stored in said address storage means; and supplying means for reading out the stitch data designated by said second designating means from said stitch data storage means and supplying the stitch data to said controlling means.

7. The sewing machine as claimed in claim 6 and wherein said display means has a plurality of display areas in each of which one of the plurality of partial patterns is to be displayed and said first designating means designates one of the plurality of partial patterns displayed in said display areas.

8. The sewing machine as claimed in claim 6, wherein the stitch data of each of the partial patterns stored in said stitch data storage means includes a plurality of coordinate data indicative of relative positions of said sewing needle and a workpiece and end data indicative of an end of the partial pattern, and the stitch data of the continuous patterns comprises stitch data of the plurality of partial patterns.

9. The sewing machine as claimed in claim 8, wherein said second designating means includes an advancing key for the advancement by an operator designated number of stitch distances and said second designating designates stitch data displaced by the number of stitch distances designated by said stitch number advancing key in an advancing direction from stitch data of the partial pattern designated by said first designating means.

10. The sewing machine as claimed in claim 8, wherein said second designating means includes a retreating key for the retreat by an operator designated number of stitch distances and designates stitch data displaced by a number of stitch distances designated by said stitch number retreating key in a retreating direction from stitch data of the partial pattern designated by said first designating means.

11. The sewing machine as claimed in claim 10, further comprising an embroidery frame for removably holding the workpiece and embroidery frame moving means for driving said embroidery frame to move in perpendicular X and Y directions, wherein the stitch data of the partial patterns stored in said stitch data storage means include embroidery data of the plurality of partial patterns having an embroidery pattern and each of the data of the partial embroidery patterns comprises a plurality of coordinate data indicative of positions to which said embroidery frame is to be successively moved and end data indicative of an end of the partial pattern.

12. The sewing machine as claimed in claim 11, wherein said stitch forming means embroiders a partial pattern in the same color.

13. A sewing machine, comprising:

a sewing needle movable in a vertical direction;

workpiece moving means for moving a workpiece;

driving means for changing the relative positions of said sewing needle and said workpiece moving means;

stitch data storage means for storing stitch data of a continuous pattern including a plurality of partial patterns, each of the partial patterns having a plurality of coordinate data indicative of relative positions of said sewing needle and said workpiece moving means and end data indicative of an end of a partial embroidery pattern stored in a predetermined order;

controlling means for controlling driving of said driving means in accordance with the stitch data stored in said pattern storage means;

display means having a plurality of display areas each for displaying one of the plurality of partial patterns therein;

stopping means for stopping said driving means;

designating means for designating, after said driving means is stopped by said stopping means, one of the plurality of partial patterns displayed on said display means;

address storage means for storing therein an address of said stitch data storage means at which stitch data at the head of the partial embroidery pattern designated by said designating means are stored;

address shifting means for designating an address of said stitch data storage means at which stitch data displaced by a number of pattern data from the address that is stored in said address storage means; and supplying means for reading out stitch data stored in said stitch data storage means designated by said address shifting means and supplying the stitch data to said controlling means.

14. The sewing machine as claimed in claim 13, wherein the coordinate data stored in said stitch data storage means indicate a stitch location and said address shifting means includes an advancing key for designating an advancing number of stitches and designates a stored position which advances by a number of stitch data corresponding to a number of stitches designated by said advancing key.

15. The sewing machine as claimed in claim 13, wherein the coordinate data stored in said stitch data storage means indicate a stitch location and said address shifting means includes a retreating key for designating a retreating number of stitches and designates a stored position which retreats by the number of stitch data corresponding to a number of stitches designated by said retreating key.

16. The sewing machine as claimed in claim 14, wherein said display means displays the advancing number of stitches.

17. The sewing machine as claimed in claim 13, wherein said stopping means includes detecting means for detecting a break of the needle thread.

18. The sewing machine as claimed in claim 6, wherein said first designating means designates from among the plurality of partial patterns at least one partial pattern, the formation of which has been completed.

19. The sewing machine as claimed in claim 18, wherein at least two of the partial patterns are completely formed and said designating means designates from among the plurality of partial patterns at least one partial pattern.

* * * * *